US009527630B2

(12) United States Patent
Whitmore et al.

(10) Patent No.: US 9,527,630 B2
(45) Date of Patent: Dec. 27, 2016

(54) UNIFORM AND ACCESSORIES ORGANIZER ASSEMBLY

(71) Applicants: Scott Whitmore, Temecula, CA (US); Mirasol Whitmore, Temecula, CA (US)

(72) Inventors: Scott Whitmore, Temecula, CA (US); Mirasol Whitmore, Temecula, CA (US)

( * ) Notice: Subject to any disclaimer, the term of this patent is extended or adjusted under 35 U.S.C. 154(b) by 367 days.

(21) Appl. No.: 14/186,068

(22) Filed: Feb. 21, 2014

(65) Prior Publication Data

US 2015/0239611 A1 Aug. 27, 2015

(51) Int. Cl.

| | |
|---|---|
| ***B65D 85/18*** | (2006.01) |
| ***B65D 33/04*** | (2006.01) |
| ***B65D 33/00*** | (2006.01) |
| ***A47G 25/14*** | (2006.01) |
| ***A47G 25/16*** | (2006.01) |
| *A45C 3/00* | (2006.01) |
| *A45C 13/02* | (2006.01) |

(52) U.S. Cl.

CPC ..... *B65D 33/04* (2013.01); *A47G 25/14* (2013.01); *A47G 25/16* (2013.01); *B65D 33/004* (2013.01); *A45C 3/004* (2013.01); *A45C 2013/026* (2013.01)

(58) Field of Classification Search

CPC ..... A45C 13/03; A45C 3/004; A45C 7/0018; A47G 25/54; B65D 85/18

USPC . 206/278, 284, 223, 320, 370, 6.1; 190/107, 190/109, 110, 111, 18 A; 224/583, 224/653; D6/328, 514; D3/274, 279, 283, D3/293, 289

See application file for complete search history.

(56) References Cited

U.S. PATENT DOCUMENTS

| | | | | |
|---|---|---|---|---|
| 4,542,824 | A | 9/1985 | Allen | |
| 4,805,749 | A | 2/1989 | Gerch | |
| 4,953,765 | A * | 9/1990 | Little | A41D 13/0012 206/373 |
| D354,851 | S | 1/1995 | Smith et al. | |
| 5,413,198 | A * | 5/1995 | Ferris | A45C 3/004 190/1 |
| D361,427 | S | 8/1995 | Taguchi et al. | |
| 6,196,718 | B1 | 3/2001 | DeChant | |
| 6,237,766 | B1 * | 5/2001 | Hollingsworth | A45C 13/02 190/103 |
| 6,276,501 | B1 * | 8/2001 | Tong | A45C 3/004 190/107 |
| 6,296,094 | B1 * | 10/2001 | Knecht | A45C 7/0095 190/107 |
| 6,334,519 | B1 * | 1/2002 | Tong | A45C 3/00 190/107 |
| 7,600,619 | B2 * | 10/2009 | Sapyta | A45C 7/0054 190/107 |

(Continued)

*Primary Examiner* — Fenn Mathew
*Assistant Examiner* — Cynthia Collado

(57) ABSTRACT

A uniform and accessories organizer assembly ensures that a user's uniform and related accessories are readily accessible when preparing to dress for the related event. The assembly includes a support panel having a front surface. A plurality of pockets is coupled to the front surface. The pockets include a plurality of primary pockets. A plurality of sheaths is provided. Each sheath is coupled to each of the primary pockets. An open upper end of each sheath defines an access opening extending into the associated sheath. Each sheath is configured to receive a labeling panel having indicia thereon through the access opening of the associated sheath for labeling of the associated primary pocket. Each sheath is translucent to permit viewing into the sheath. A hook is coupled to the support panel.

13 Claims, 4 Drawing Sheets

(56) References Cited

U.S. PATENT DOCUMENTS

| | | | | |
|---|---|---|---|---|
| 7,604,102 | B2 * | 10/2009 | Albritton | A45C 3/00<br>190/107 |
| 2007/0044877 | A1 * | 3/2007 | Davidoff | A45C 1/024<br>150/113 |

* cited by examiner

UNIFORM AND ACCESSORIES ORGANIZER ASSEMBLY

BACKGROUND OF THE DISCLOSURE

Field of the Disclosure

The disclosure relates to organizer assemblies and more particularly pertains to a new organizer assembly for ensuring that a user's uniform and related accessories are organized and readily accessible when preparing to dress for the related event.

Summary of the Disclosure

An embodiment of the disclosure meets the needs presented above by generally comprising a support panel having a front surface. A plurality of pockets is coupled to the front surface. The pockets include a plurality of primary pockets. A plurality of sheaths is provided. Each sheath is coupled to each of the primary pockets. Each sheath has an open upper end, a closed bottom end, a first lateral side and a second lateral side. The open upper end of each sheath defines an access opening extending into the associated sheath. Each sheath is configured to receive a panel having indicia thereon through the access opening of the associated sheath for labeling of the associated primary pocket. Each sheath is translucent to permit viewing into the sheath. A hook is coupled to the support panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
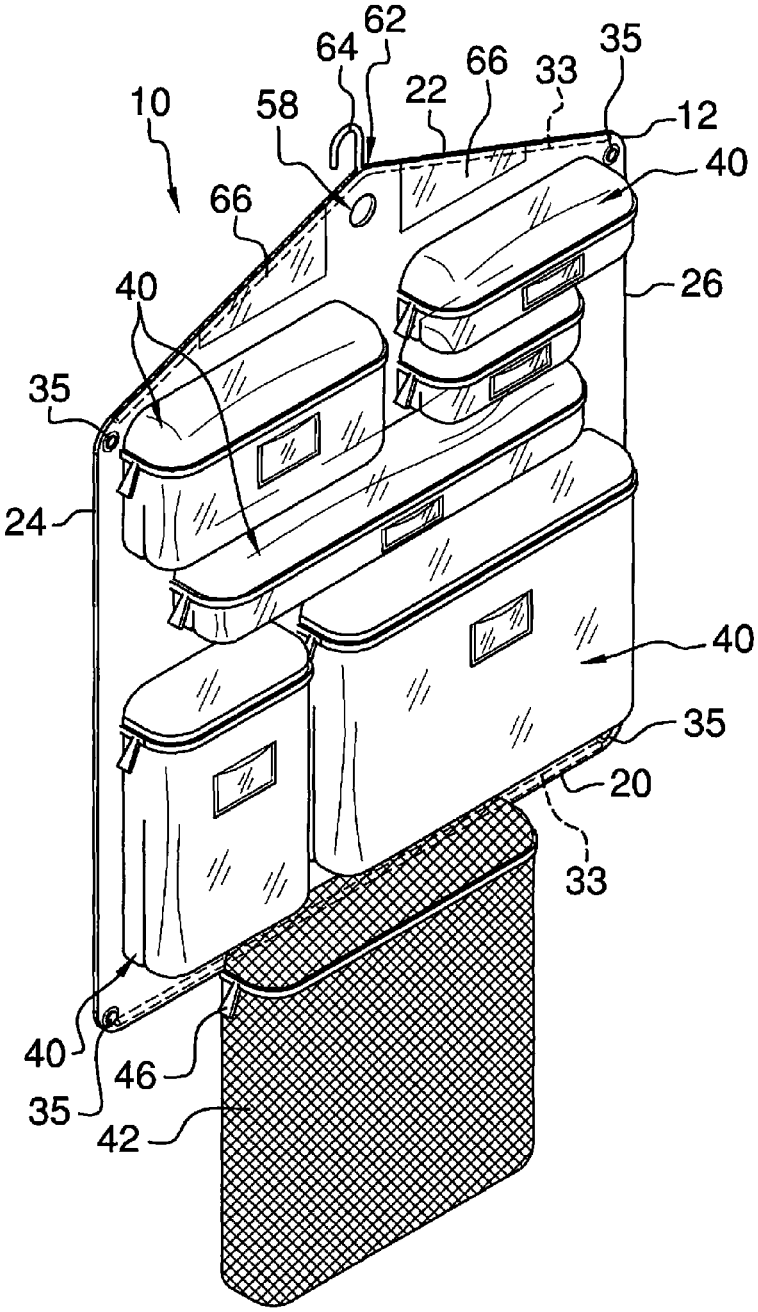
FIG. 1 is a top front side perspective view of a uniform and accessories organizer assembly according to an embodiment of the disclosure.
Figure 2:
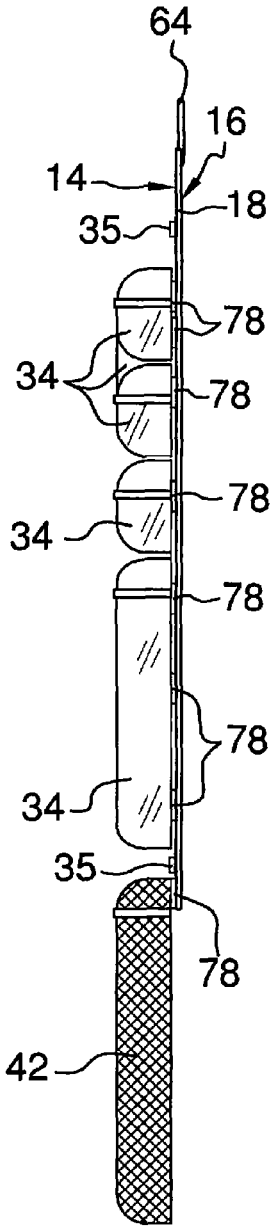
FIG. 2 is a side view of an embodiment of the disclosure.
Figure 3:
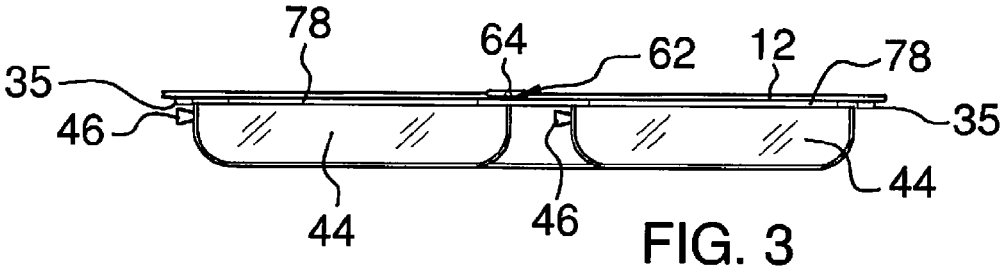
FIG. 3 is a top view of an embodiment of the disclosure.
Figure 4:
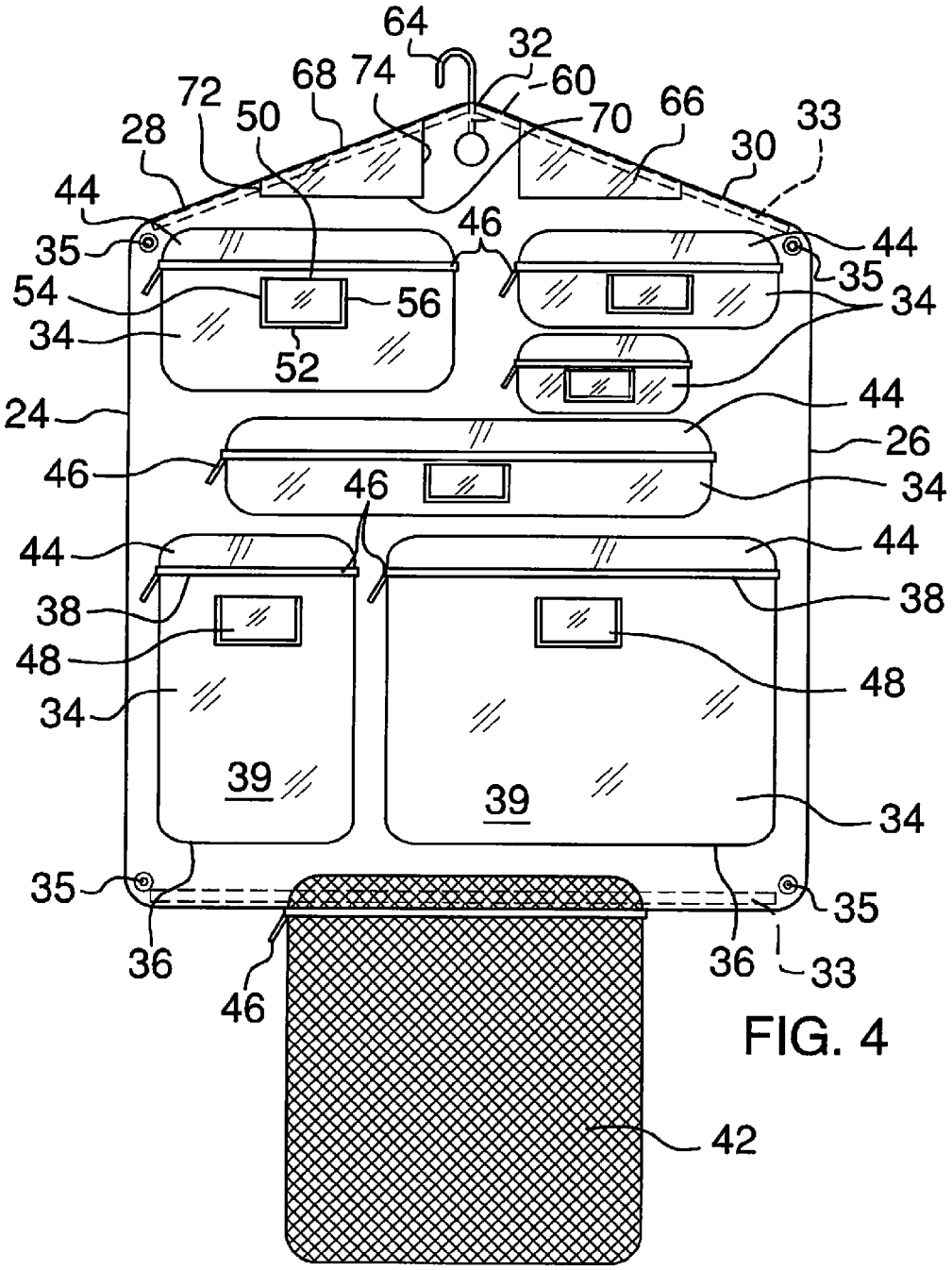
FIG. 4 is a front view of an embodiment of the disclosure.
Figure 5:
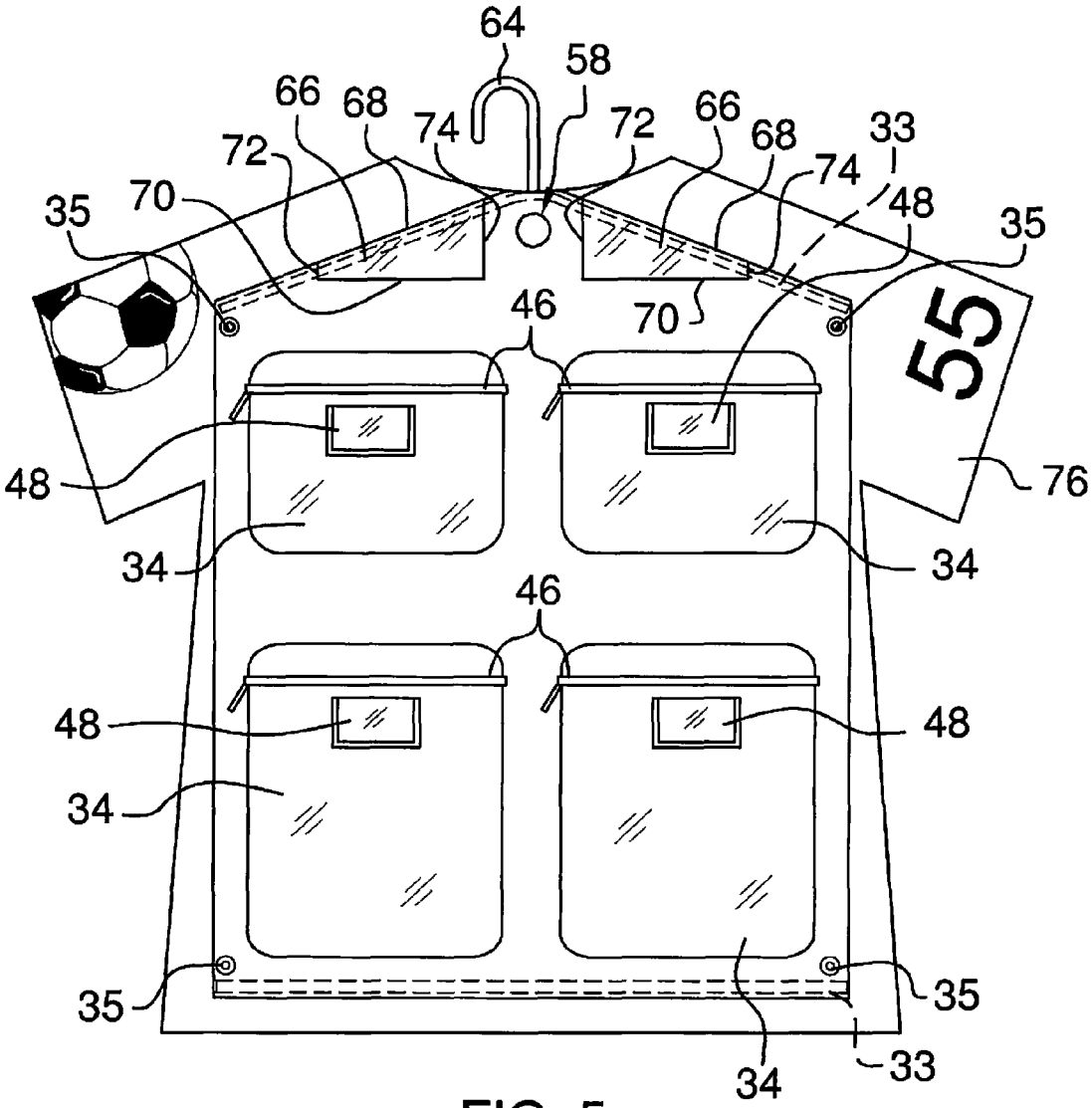
FIG. 5 is a front view of an alternative embodiment of the disclosure.
Figure 6:
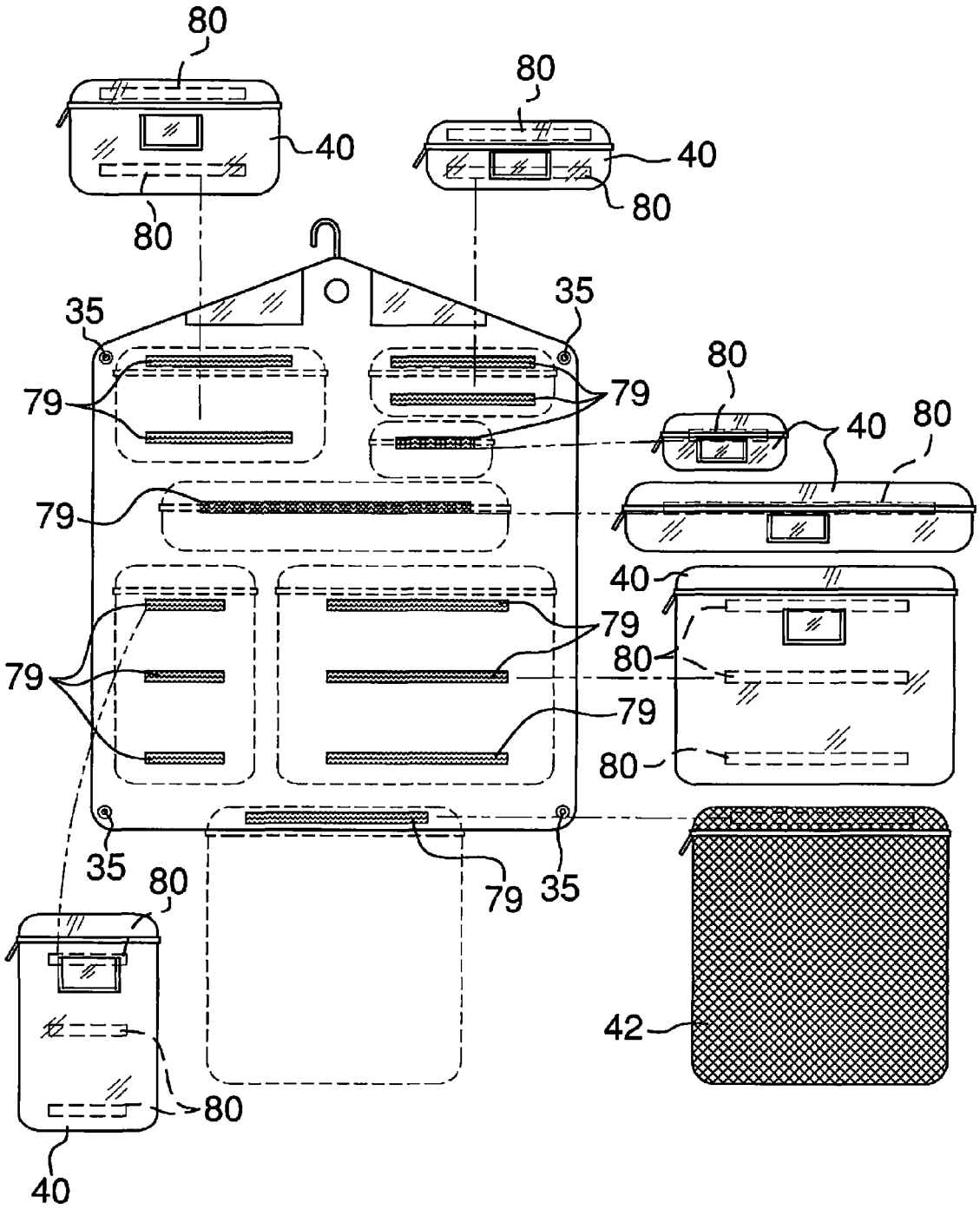
FIG. 6 is an exploded front view of an embodiment of the disclosure.

With reference now to the drawings, and in particular to FIGS. 1 through 6 thereof, a new organizer assembly embodying the principles and concepts of an embodiment of the disclosure and generally designated by the reference numeral 10 will be described.

As best illustrated in FIGS. 1 through 6, the uniform and accessories organizer assembly 10 generally comprises a planar support panel 12 having a front surface 14, a rear surface 16 and a perimeter edge 18 extending between the front surface 14 and the rear surface 16. The perimeter edge 18 includes a bottom portion 20, an upper portion 22, a first lateral portion 24 and a second lateral portion 26. The upper portion 22 may have a first section 28 slanting upwardly and inwardly from the first lateral portion 24 and a second section 30 slanting upwardly and inwardly from the second lateral portion 26. The first 28 and second 30 sections may be joined at an apex 32 of the support panel 12. The support panel 12 may be constructed from a flexible material, such as nylon, canvas or like material. The support panel 12 may have one or more reinforcement members 33, such as rods, dowels or the like, attached thereto for additional strength. The reinforcement members 33 may be constructed from metal, wood or like material. The support panel 12 may have a height between approximately 38.0 centimeters and 105.0 centimeters; a width between approximately 12.0 centimeters and 76.0 centimeters; and a depth between approximately 5.0 centimeters and 10.0 centimeters. A plurality of connectors 35 may be coupled to the support panel 12 on the front surface 14. Each of the connectors 35 is removably couplable to another one of the connectors 35 to allow the support panel 12 to be folded in half and retained in a folded position. The connectors 35 may comprise snaps, hook and loop couplers or the like.

A plurality of pockets 34 is coupled to the front surface 14. Each of the pockets 34 has a closed bottom 36, a top perimeter edge 38 and a perimeter surface 39 extending between the closed bottom 36 and the top perimeter edge 38 of the associated pocket 34. The top perimeter edge 38 of each pocket 34 defines an access opening into an interior space of the associated pocket 34. The pockets 34 include a plurality of primary pockets 40 and a secondary pocket 42. The secondary pocket 42 is attached to the support panel 12 proximate the bottom portion 20 of the perimeter edge 18 of the support panel 12 such that the secondary pocket 42 extends downwardly below the support panel 12. The secondary pocket 42 may be formed of a flexible netted material. Each of the primary pockets 40 is translucent to permit viewing into the interior space of the primary pockets 40. Each of the primary pockets 40 may be constructed from a flexible and durable material, such as vinyl, plastic or the like. A plurality of couplers 78 releasably couples each of the pockets 34 to the support panel 12. Each of the couplers 78 comprises a first mating member 79 coupled to the support panel 12 and a second mating member 80 coupled to an associated one of the pockets 34. The couplers 78 may comprise hook and loop fasteners, snaps or other conventional fasteners.

A plurality of flaps 44 is provided. Each of the flaps 44 is coupled to an associated one of the pockets 34 wherein each of the flaps 44 is positionable over the access opening of the associated pocket 34. A plurality of closures 46 is provided. Each closure 46 is attached to an associated one of the pockets 34 and is actuated to a closed state closing the access opening of the associated pocket 34 or to an opened state allowing access to the interior space of the associated pocket 34. Each closure 46 may comprise a zipper being coextensive with the access opening of the associated pocket 34, though hook and loop connectors, snaps or the like may be used as well.

A plurality of sheaths 48 is provided. Each of the sheaths 48 is coupled to an associated one of the primary pockets 40. Each sheath 48 has an open upper end 50, a closed bottom end 52, a first lateral side 54 and a second lateral side 56. The open upper end 50 of each sheath 48 defines an access opening extending into the associated sheath 48. Each sheath 48 is configured to receive a labeling panel having indicia thereon through the access opening of the associated sheath 48 for labeling of the associated primary pocket 40. Each sheath 48 is translucent to permit viewing into the sheath 48.

A hole 58 is positioned in the support panel 12. The hole 58 is positioned proximate the apex 32. A channel 60 extends between the hole 58 and the apex 32. The apex 32 has an opening 62 positioned therein providing access to the channel 60. A hook 64 is coupled to the support panel 12. The hook 64 may be an upper portion of a conventional clothes hanger. The hook 64 is insertable through the hole 58 and the channel 60 and is extendable outwardly through the opening 62.

A plurality of sleeves 66 is coupled to the support panel 12 and is positioned on the front surface 14. Each of the sleeves 66 has an open top end 68, a closed lower end 70, a first side 72 and a second side 74. The open top end 68 of each sleeve 66 defines an access opening extending into the associated sleeve 66. Each sleeve 66 is configured to receive a labeling panel having indicia thereon through the access opening of the associated sleeve 66 for labeling of the support panel 12. Each sleeve 66 is translucent to permit viewing into each sleeve 66 and may be constructed from plastic or like material.

In use, as stated above and shown in the Figures, a user obtains a plurality of labeling panels, such as pieces of paper or the like, and writes on each of them so that each labeling panel designates various accessories of a uniform. The labeling panels are then placed into an associated sheath 48. A garment portion of the uniform, such as a jersey 76, pants or the like, is positioned on the hanger and the hook 64 is then extended through the hole 58 and outwardly through the opening 62. The accessory that corresponds to the writing on the associated sheath 48 is then placed into the associated pocket 34 so that the labeling panels on the pockets 34 describe the accessory positioned in the pocket 34. Shoes, cleats or the like can be positioned within the secondary pocket 42. The user can view into each of the pockets 34 to quickly determine if any portion of the uniform is missing. Such allows the user to determine at a glance whether all parts of a uniform are present. The assembly 10 can then be stored in a garment bag or folded using the connectors 35 for compact storage within a suitcase or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A uniform and accessories organizer assembly comprising:

a support panel having a front surface;

a plurality of pockets coupled to said front surface, each of said pockets having a closed bottom, a top perimeter edge and a perimeter surface extending between said closed bottom and said top perimeter edge of said associated pocket, said top perimeter edge of each said pocket defining an access opening into an interior space of said associated pocket, said pockets including a plurality of primary pockets;

a plurality of sheaths, each of said sheaths being coupled to an associated one of said primary pockets, each said sheath having an open upper end, a closed bottom end, a first lateral side and a second lateral side, said open upper end of each said sheath defining an access opening extending into said associated sheath, each said sheath being configured to receive a labeling panel having indicia thereon through said access opening of said associated sheath for labeling of said associated primary pocket, each said sheath being translucent to permit viewing into said sheath;

a hook being coupled to said support panel;

a hole positioned in said support panel, said hole being positioned proximate said apex;

a channel extending between said hole and said apex, said apex having an opening positioned therein; and said hook being insertable through each of said hole and said channel, and being extendable outwardly through said opening.

2. The assembly of claim 1, further comprising said support panel further including a rear surface and a perimeter edge extending between said front surface and said rear surface, said perimeter edge including a bottom portion, an upper portion, a first lateral portion and a second lateral portion, said upper portion having a first section slanting upwardly and inwardly from said first lateral portion and a second section slanting upwardly and inwardly from said second lateral portion, said first and second sections being joined at an apex of said support panel.

3. The assembly of claim 1, further comprising each of said primary pockets being translucent to permit viewing into said interior space of said primary pockets.

4. The assembly of claim 1, further comprising each of said primary pockets being constructed from a flexible material.

5. The assembly of claim 1, said plurality of pockets further including a secondary pocket being attached to said support panel proximate a bottom portion of said perimeter edge of said support panel such that said secondary pocket extends downwardly below said support panel.

6. The assembly of claim 5, further comprising said secondary pocket being formed of a flexible netted material.

7. The assembly of claim 1, further comprising:

a plurality of flaps, each of said flaps being coupled to an associated one of said pockets wherein each of said flaps is positionable over said access opening of said associated pocket; and a plurality of closures, each said closure being attached to an associated one of said pockets and being actuated to a closed state closing said access opening of said associated pocket or to an opened state allowing access to said interior space of said associated pocket.

8. The assembly of claim 7, further comprising each said closure comprising a zipper being coextensive with said access opening of said associated pocket.

9. The assembly of claim 1, further comprising a sleeve coupled to said support panel and being positioned on said front surface, said sleeve having an open top end, a closed lower end, a first side and a second side, said open top end defining an access opening extending into said sleeve, said sleeve being configured to receive a labeling panel having indicia thereon through said access opening of said sleeve for labeling of said support panel, said sleeve being translucent to permit viewing into said sleeve.

10. The assembly of claim 1, further comprising each of said pockets being removably coupled to said support panel.

11. The assembly of claim 1, further comprising said support panel being constructed from a flexible material.

12. The assembly of claim 11, further copmrising a plurality of connectors coupled to said support panel on said front surface, each of said connectors being removably couplable to a selectable one of said connectors.

13. A uniform and accessories organizer assembly comprising:

a planar support panel having a front surface, a rear surface and a perimeter edge extending between said front surface and said rear surface, said perimeter edge including a bottom portion, an upper portion, a first lateral portion and a second lateral portion, said upper portion having a first section slanting upwardly and inwardly from said first lateral portion and a second section slanting upwardly and inwardly from said second lateral portion, said first and second sections being joined at an apex of said support panel, said support panel being constructed from a flexible material;

a plurality of connectors coupled to said support panel on said front surface, each of said connectors being removably couplable to a selectable one of said connectors;

a plurality of pockets coupled to said front surface, each of said pockets having a closed bottom, a top perimeter edge and a perimeter surface extending between said closed bottom and said top perimeter edge of said associated pocket, said top perimeter edge of each said pocket defining an access opening into an interior space of said associated pocket, said pockets including a plurality of primary pockets and a secondary pocket, said secondary pocket being attached to said support panel proximate said bottom portion of said perimeter edge of said support panel such that said secondary pocket extends downwardly below said support panel, said secondary pocket being formed of a flexible netted material, each of said primary pockets being translucent to permit viewing into said interior space of said primary pockets, each of said primary pockets being constructed from a flexible material, each of said pockets being removably coupled to said support panel;

a plurality of flaps, each of said flaps being coupled to an associated one of said pockets wherein each of said flaps is positionable over said access opening of said associated pocket;

a plurality of closures, each said closure being attached to an associated one of said pockets and being actuated to a closed state closing said access opening of said associated pocket or to an opened state allowing access to said interior space of said associated pocket, each said closure comprising a zipper being coextensive with said access opening of said associated pocket;

a plurality of sheaths, each of said sheaths being coupled to an associated one of said primary pockets, each said sheath having an open upper end, a closed bottom end, a first lateral side and a second lateral side, said open upper end of each said sheath defining an access opening extending into said associated sheath, each said sheath being configured to receive a labeling panel having indicia thereon through said access opening of said associated sheath for labeling of said associated primary pocket, each said sheath being translucent to permit viewing into said sheath;

a hole positioned in said support panel, said hole being positioned proximate said apex;

a channel extending between said hole and said apex, said apex having an opening positioned therein;

a hook being coupled to said support panel, said hook being insertable through each of said hole, said channel and being extendable outwardly through said opening; and a plurality of sleeves coupled to said support panel and being positioned on said front surface, each of said sleeves having an open top end, a closed lower end, a first side and a second side, said open top end of each said sleeve defining an access opening extending into said associated sleeve, each said sleeve being configured to receive a labeling panel having indicia thereon through said access opening of said associated sleeve for labeling of said support panel, each said sleeve being translucent to permit viewing into each said sleeve.

* * * * *